US011482370B2

(12) United States Patent
Kim

(10) Patent No.: US 11,482,370 B2
(45) Date of Patent: Oct. 25, 2022

(54) COIL ELECTRONIC COMPONENT

(71) Applicant: SAMSUNG ELECTRO-MECHANICS CO., LTD., Suwon-si (KR)

(72) Inventor: Jae Hun Kim, Suwon-si (KR)

(73) Assignee: SAMSUNG ELECTRO-MECHANICS CO., LTD., Suwon-si (KR)

( * ) Notice: Subject to any disclaimer, the term of this patent is extended or adjusted under 35 U.S.C. 154(b) by 582 days.

(21) Appl. No.: 16/522,136

(22) Filed: Jul. 25, 2019

(65) Prior Publication Data

US 2020/0365312 A1 Nov. 19, 2020

(30) Foreign Application Priority Data

May 13, 2019 (KR) ..... 10-2019-0055469

(51) Int. Cl.

| | |
|---|---|
| ***H01F 5/00*** | (2006.01) |
| ***H01F 27/28*** | (2006.01) |
| ***H01F 27/29*** | (2006.01) |
| ***H01F 27/32*** | (2006.01) |
| ***H01F 41/04*** | (2006.01) |
| ***H01F 41/12*** | (2006.01) |

(52) U.S. Cl.

CPC ..... *H01F 27/2804* (2013.01); *H01F 27/29* (2013.01); *H01F 27/323* (2013.01); *H01F 41/041* (2013.01); *H01F 41/122* (2013.01); *H01F 2027/2809* (2013.01)

(58) Field of Classification Search

CPC ..... H01F 27/2804

USPC ..... 336/200

See application file for complete search history.

(56) References Cited

U.S. PATENT DOCUMENTS

| | | | | |
|---|---|---|---|---|
| 2014/0009254 | A1* | 1/2014 | Ohkubo | H01F 17/0033 336/192 |
| 2014/0184374 | A1 | 7/2014 | Park et al. | |
| 2015/0102891 | A1* | 4/2015 | Yoon | H01F 27/2804 336/200 |
| 2016/0189840 | A1* | 6/2016 | Ahn | H01F 17/04 29/602.1 |
| 2016/0343500 | A1 | 11/2016 | Jung et al. | |

(Continued)

FOREIGN PATENT DOCUMENTS

| | | | |
|---|---|---|---|
| JP | 2018-174306 | A | 11/2018 |
| JP | 2018-190828 | A | 11/2018 |
| KR | 10-2014-0085997 | A | 7/2014 |

(Continued)

OTHER PUBLICATIONS

Korean Office Action dated Apr. 24, 2020 issued in Korean Patent Application No. 10-2019-005549 (with English translation).

*Primary Examiner* — Ronald Hinson

(74) *Attorney, Agent, or Firm* — Morgan, Lewis & Bockius LLP

(57) ABSTRACT

A coil electronic component includes a body comprising a magnetic material, an insulating substrate comprising a support portion disposed inside the body, and a tip extending from the support portion and exposed from an external surface of the body, a coil portion disposed on the support portion, and a lead-out portion extending from one end of the coil portion, disposed on the tip, and exposed from the external surface of the body. The lead-out portion has a slit exposed from the external surface of the body.

20 Claims, 16 Drawing Sheets

(56) References Cited

U.S. PATENT DOCUMENTS

| | | | | |
|---|---|---|---|---|
| 2018/0286561 | A1* | 10/2018 | Shimoichi | H01F 27/28 |
| 2018/0323003 | A1 | 11/2018 | Fujii et al. | |

FOREIGN PATENT DOCUMENTS

| | | | |
|---|---|---|---|
| KR | 10-2016-0136048 | A | 11/2016 |
| KR | 10-2017-0003432 | A | 1/2017 |
| KR | 10-1709841 | B1 | 2/2017 |
| KR | 10-2018-0012621 | A | 2/2018 |

* cited by examiner

COIL ELECTRONIC COMPONENT

CROSS-REFERENCE TO RELATED APPLICATION(S)

This application claims benefit of priority to Korean Patent Application No. 10-2019-0055469 filed on May 13, 2019 in the Korean Intellectual Property Office, the disclosure of which is incorporated herein by reference in its entirety.

TECHNICAL FIELD

The present disclosure relates to a coil electronic component.

BACKGROUND

An inductor, a coil electronic component, is a representative passive element used in an electronic device, together with a resistor and a capacitor.

A thin-film coil component is manufactured by forming a coil on an insulating substrate using a plating method to prepare a coil substrate, laminating a magnetic composite sheet, in which a magnetic powder particles and a resin are mixed, on the coil substrate, forming external electrodes on external surfaces of a body, and performing a dicing process.

In the dicing process after formation of the lead-out portion, a portion of a metal component, constituting the lead-out portion, is pushed to a surface of the body due to ductility of the metal and external force generated by a dicing blade. There is an increasing need to prevent bleeding of the lead-out portion while reducing an overall size of the coil electronic component with the trend toward miniaturization of an electronic component.

SUMMARY

An aspect of the present disclosure is to provide a miniaturized coil component which may prevent a portion of a metal component, constituting a lead-out portion, from being pushed to a surface of a body.

According to an aspect of the present disclosure, a coil electronic component includes a body comprising a magnetic material, an insulating substrate comprising a support portion disposed inside the body, and a tip extending from the support portion and exposed from an external surface of the body, a coil portion disposed on the support portion, and a lead-out portion extending from one end of the coil portion, disposed on the tip, and exposed from the external surface of the body. The lead-out portion has a slit exposed from the external surface of the body.

According to an aspect of the present disclosure, a coil electronic component includes a body comprising a magnetic material, an insulating substrate comprising a support portion disposed inside the body, and first and second tips extending from the support portion and exposed from first and second surfaces of the body in a length direction of the body, respectively, a coil portion disposed on the support portion, and first and second lead-out portions extending from ends of the coil portion, disposed on the first and second tips, and exposed from the first and second surfaces of the body, respectively. The first and second lead-out portions are exposed from a third surface of the body connecting the first and second surfaces. The first lead-out portion has a first slit exposed from one of the first surface or the third surface. The second lead-out portion has a second slit exposed from one of the second surface or the third surface.

BRIEF DESCRIPTION OF DRAWINGS

The above and other aspects, features, and advantages of the present disclosure will be more clearly understood from the following detailed description, taken in conjunction with the accompanying drawings, in which:

FIG. 3 is viewed in direction A;

FIG. 3 is viewed in direction A, illustrating a shape of a first conductor layer and a modified example thereof, respectively;

FIG. 9 is viewed in direction A;

FIG. 13 is viewed in direction A;

FIG. 15 is viewed in direction A.

DETAILED DESCRIPTION

Figure 1:
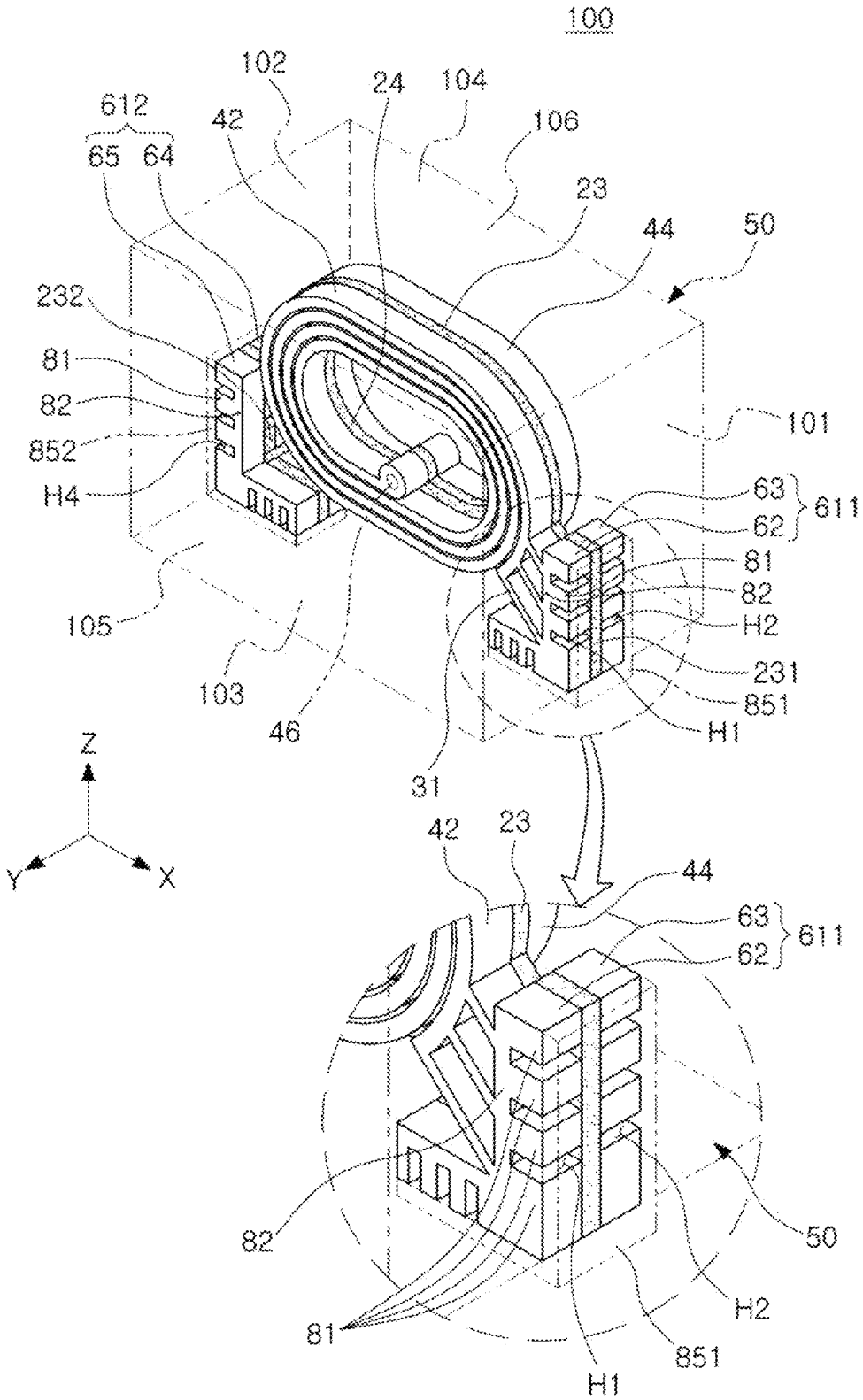
FIG. 1 is a schematic perspective view of a coil electronic component according to a first embodiment in the present disclosure.

The terminology used herein to describe embodiments of the present disclosure is not intended to limit the scope of the present disclosure. The articles "a," and "an" are singular in that they have a single referent, however the use of the singular form in the present document should not preclude the presence of more than one referent. In other words, elements of the present disclosure referred to in the singular may number one or more, unless the context clearly indicates otherwise. It will be further understood that the terms "comprise," "comprising," "include," and/or "including," when used herein, specify the presence of stated features, numbers, steps, operations, elements, and/or components but do not preclude the presence or addition of one or more other features, numbers, steps, operations, elements, components, and/or groups thereof.

In a description of the embodiment, in a case in which any one element is described as being formed on (or under) another element, such a description includes both a case in which the two elements are formed to be in direct contact with each other and a case in which the two elements are in indirect contact with each other such that one or more other elements are interposed between the two elements. In addition, when in a case in which one element is described as being formed on (or under) another element, such a description may include a case in which the one element is formed at an upper side or a lower side with respect to the another element.

Also, the sizes of components in the drawings may be exaggerated for convenience of description. In other words, since the sizes and thicknesses of components in the drawings are arbitrarily illustrated for convenience of description, the following embodiments are not limited thereto.

In the drawing, an X direction will be defined as a first direction or a length direction, a Y direction will be defined as a second direction or a width direction, and a Z direction will be defined as a third direction or a thickness direction.

Hereinafter, the exemplary embodiments of the present disclosure will be described in detail with reference to the accompanying drawings. The same or corresponding elements will be consistently denoted by the same respective reference numerals and described in detail no more than once regardless of drawing symbols.

Various types of electronic components are used in an electronic device. Various types of coil components may be appropriately used between such electronic components for the purpose of noise removal or the like.

In an electronic device, a coil component may be used as, for example, a power inductor, a high-frequency (HF) inductor, a general bead, a bead for high frequency (GHz Bead), a common mode filter, and the like.

Hereinafter, the present disclosure will be described under the assumption that a coil electronic component 100 according to example embodiments is a thin-film inductor used in a power line of a power supply circuit. However, a coil electronic component according to example embodiments may be appropriately applied to a chip bead, a chip filter, or the like in addition to the thin-film inductor.

Embodiment 1

Figure 2:
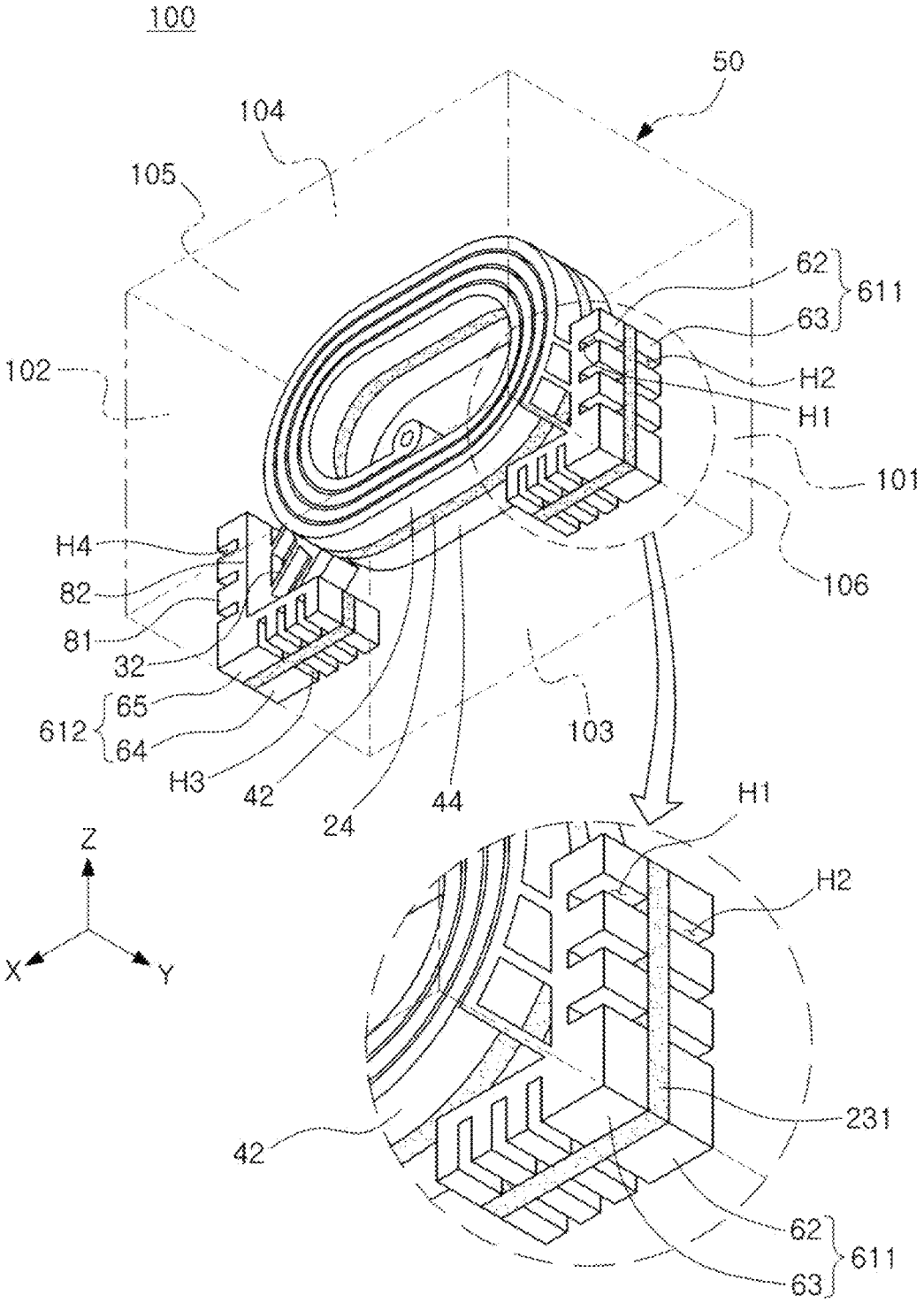
FIG. 2 is a perspective view of the coil electronic component according to the first embodiment, illustrated in FIG. 1, when viewed from a third surface.
Figure 3:
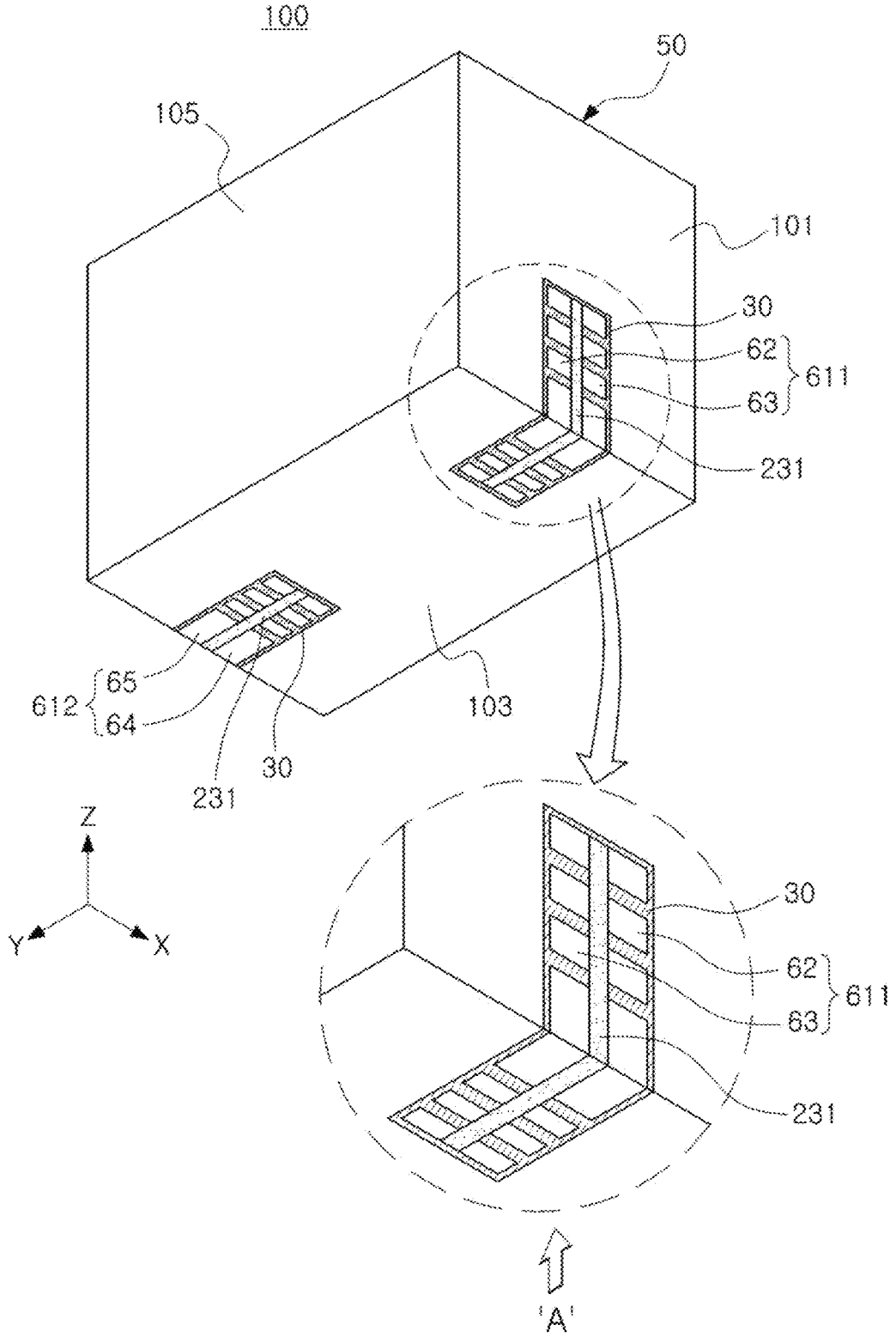
FIG. 3 is a perspective view of a body of the coil electronic component according to the first embodiment, illustrated in FIG. 1, when viewed from the third surface.
Figure 4:
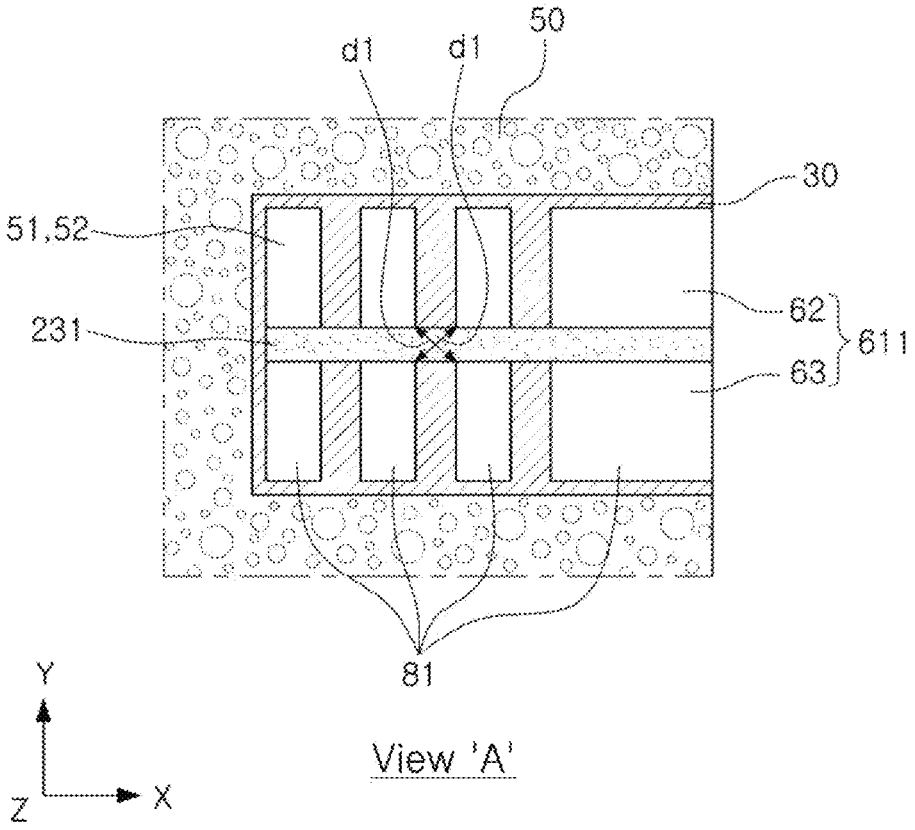
FIG. 4 is a diagram when
Figure 5:
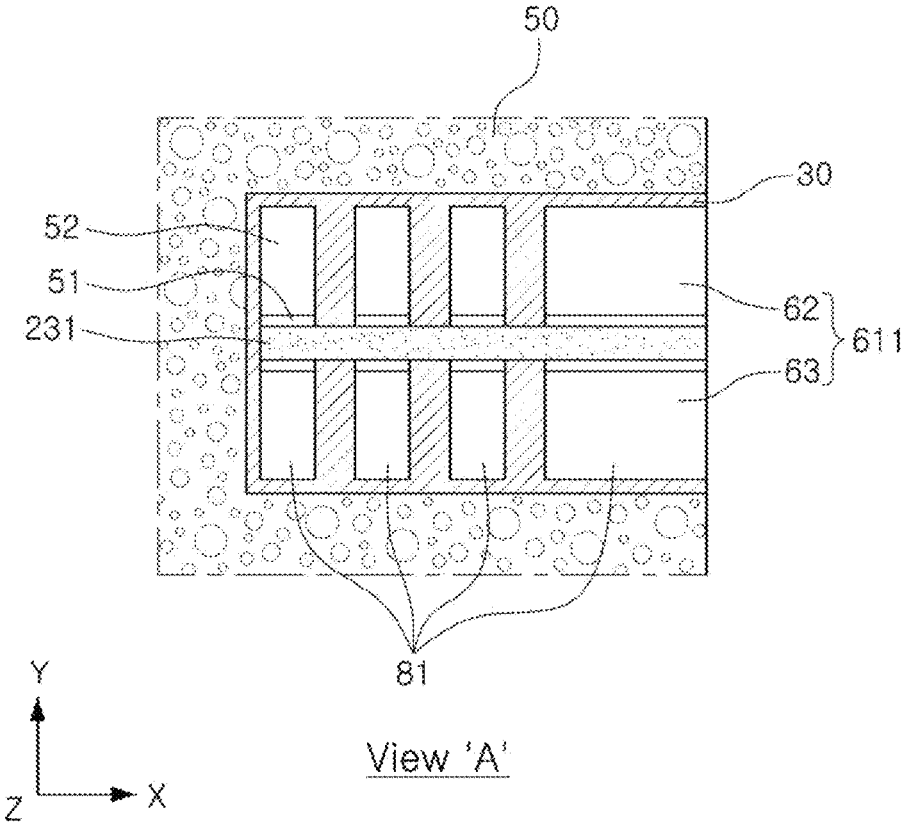
FIGS. 5 and 6 are diagrams, when
Figure 6:
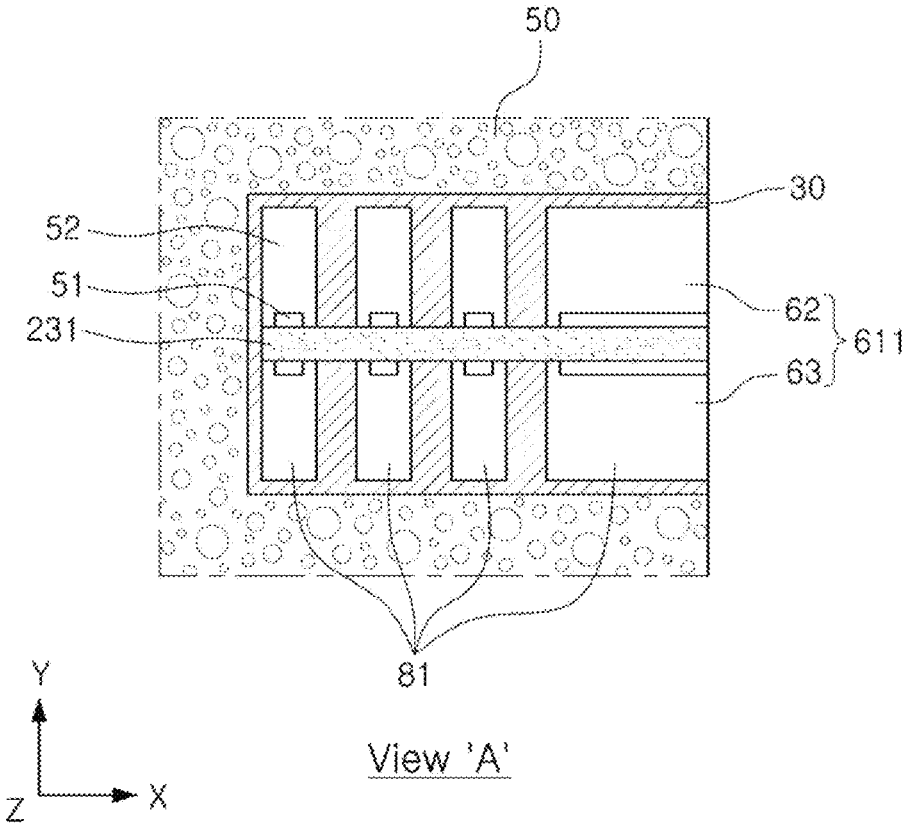

FIG. 1 is a schematic perspective view of a coil electronic component according to a first embodiment in the present disclosure. FIG. 2 is a perspective view of the coil electronic component according to the first embodiment, illustrated in FIG. 1, when viewed from a third surface, and FIG. 3 is a perspective view of a body of the coil electronic component according to the first embodiment, illustrated in FIG. 1, when viewed from the third surface. FIG. 4 is a diagram when FIG. 3 is viewed in direction A, and FIGS. 5 and 6 are diagrams, when FIG. 3 is viewed in direction A, illustrating a shape of a first conductor layer and a modified example thereof, respectively.

For ease of description, FIG. 2 particularly illustrates an internal structure of the coil electronic component according to the first embodiment without illustrating external electrodes and insulating layers, and FIG. 2 particularly illustrates an exterior of the coil electronic component according to the first embodiment without illustrating external electrodes.

Referring to FIGS. 1 to 6, a coil electronic component 100 according to the first embodiment includes a body 50, an insulating substrate 23, coil portions 42 and 44, and lead-out portions 611 and 612 and may further include external electrodes 851 and 852 and insulating layers 30.

The body 50 may form an exterior of the coil electronic component 100, and the insulating substrate 23 may be disposed inside the body 50.

The body 50 may be formed to have an approximately hexahedral shape.

The body 50 may have a first surface 101 and a second surface 102 opposing each other in a length direction X, a third surface 103 and a fourth surface 104 opposing each other in a thickness direction Z, and a fifth surface 105 and a sixth surface 106 opposing each other in a width direction Y, on the basis of FIG. 1. Each of the third and fourth surfaces 103 and 104, opposing each other, connects the first and second surfaces 101 and 102 opposing each other.

As an example, the body 50 may be formed such that the coil electronic component 100, in which external electrodes 851 and 852 to be described later are formed, has a length of 0.2±0.1 mm, a width of 0.25±0.1 mm, and a thickness of 0.4 mm, but is not limited thereto.

The body 50 may include a magnetic material and an insulating resin. Specifically, the body 50 may be formed by laminating an insulating resin and at least one magnetic sheet including a magnetic material dispersed in the insulating resin. However, the body 50 may have another structure other than the structure in which the magnetic materials are disposed in the insulating resin. For example, the body 50 may include a magnetic material such as ferrite.

The magnetic material may be ferrite or magnetic metal powder particles.

The Ferrite powder particles may be at least one of, for example, spinel type ferrites such as ferrites that are Mg—Zn-based, Mn—Zn-based, Mn—Mg-based, Cu—Zn-based, Mg—Mn—Sr-based, Ni—Zn-based, hexagonal ferrites such as ferrites that are Ba—Zn-based, Ba—Mg-based, Ba—Ni-based, Ba—Co-based, Ba—Ni—Co-based, or the like, garnet ferrites such as Y-based ferrite, and Li-based ferrite.

The magnetic metal powder particles may include at least one selected from a group consisting of iron (Fe), silicon (Si), chromium (Cr), cobalt (Co), molybdenum (Mo), aluminum (Al), niobium (Nb), copper (Cu), and nickel (Ni). For example, the magnetic metal powder particles may include at least one of pore ion power particles, Fe—Si-based alloy powder particles, Fe—Si—Al-based alloy powder particles, Fe—Ni-based alloy powder particles, Fe—Ni—Mo-based alloy powder particles, Fe—Ni—Mo—Cu-based alloy powder particles, Fe—Co-based alloy powder particles, Fe—Ni—Co-based alloy powder particles, Fe—Cr-based alloy powder particles, Fe—Cr—Si-based alloy powder particles, Fe—Si—Cu—Nb-based alloy powder particles, Fe—Ni—Cr-based alloy powder particles, and Fe—Cr—Al-based alloy powder particles.

The magnetic metal powder particles may be amorphous or crystalline. For example, the magnetic metal powder particles may Fe—Si—B—Cr based amorphous alloy powder particles, but are not limited thereto.

Each of the ferrite and magnetic metal powder particles may have an average diameter of about 0.1 μm to about 30 μm, but the average diameter is not limited thereto.

The body 50 may include two or more types of magnetic materials dispersed in a resin. The expression "different types of magnetic materials" refers to the fact that magnetic materials, dispersed in a resin, are distinguished from each other by any one of average diameter, composition, crystallinity, and shape.

The insulating resin may include epoxy, polyimide, liquid crystal polymer, and the like, alone or in combination, but is not limited thereto.

The insulating substrate 23 may be disposed inside the body 50 and may have both surfaces on which first and second coil portions 42 and 44 to be described later are disposed, respectively. The insulating substrate 23 may include a support portion 24, disposed inside the body 50, and tips 231 and 232 extending from the support portion 24 to be exposed to the external surfaces of the body 50. In the insulating substrate 23, the support portion 24 may be one region, disposed between the first and second coil portions 42 and 44 to be described later, supporting the coil portions 42 and 44. Specifically, the first tip 231 may extend from the support portion 24 and may be disposed between a first lead-out pattern 62 and a first dummy pattern 63 to support the first lead-out pattern 62 and the first dummy pattern 63 to be described later.

The insulating substrate 23 may be formed of an insulating material including a thermosetting resin such as an epoxy resin, a thermoplastic resin such as a polyimide resin, or an insulating a photosensitive insulating resin, or an insulating material in which such an insulating resin is impregnated with a reinforcing material such as glass fiber and inorganic filler. For example, the insulating substrate 23 may be formed of an insulating material such as prepreg, Ajinomoto Build-up Film (ABF), FR-4, a Bismaleimide Triazine (BT) film, a photoimageable dielectric (PID) film, or the like, but an insulating material of the insulating substrate 23 is not limited thereto.

The inorganic filler may be at least one selected from the group consisting of silica ($SiO_2$), alumina ($Al_2O_3$), silicon carbide (SiC), barium sulfate ($BaSO_4$), talc, clay, mica powder particles, aluminum hydroxide ($AlOH_3$), magnesium hydroxide ($Mg(OH)_2$), a calcium carbonate ($CaCO_3$), magnesium carbonate ($MgCO_3$), magnesium oxide (MgO), boron nitride (BN), aluminum borate ($AlBO_3$), barium titanate ($BaTiO_3$), and calcium zirconate ($CaZrO_3$).

The insulating substrate 23 may provide better rigidity when it is formed of an insulating material which includes a reinforcing material. The insulating substrate 23 may be advantageous in reducing an entire thickness of the coil portions 42 and 44 when it is formed of an insulating material which does not include a glass fiber.

The coil portions 42 and 44 may include first and second coil portions 42 and 44, disposed on one surface and the other surface of the insulating substrate 23 opposing each other, and may exhibit characteristics of a coil electronic component. For example, when the coil electronic component 100 is used as a power inductor, the coil portions 42 and 44 may store an electric field as a magnetic field and maintain an output voltage to stabilize power of an electronic device.

The coil portions 42 and 44 may be disposed on the support portion 24 of the insulating substrate 23. The first coil portion 42 and the second coil portion 44 may face each other and may be electrically connected to each other through a via electrode 46 penetrating through the support portion 24. The first coil portion 42 may be electrically connected to the first lead-out portion 62 and the second coil portion 44 may be electrically connected to the second lead-out portion 64, as will be described later.

Each of the first and second coil portions 42 and 44 may have a flat spiral shape forming at least one turn about a core portion. As an example, the first coil portion 42 may form at least one turn about the core portion on one surface of the insulating substrate 23.

According to the first embodiment, the coil portions 42 and 44 may be formed to stand upright to the third surface 103 or the fourth surface 104 of the body 50.

As illustrated in FIG. 1, the expression "formed to stand upright to the third surface 103 or the fourth surface 104 of the body 50" refers to the fact that contact surfaces between the coil portions 42 and 44 and the insulating substrate are formed to be perpendicular or substantially perpendicular to the third surface 103 or the fourth surface 104 of the body 50. For example, the contact surface between the coil portions 42 and 44 and the insulating substrate 23 may be formed to stand upright to the third surface 103 or the fourth surface 104 of the body 50 at an angle of 80 to 100 degrees.

The coil portions 42 and 44 may be formed parallel to the fifth surface 105 and the sixth surface 106 of the body 50. For example, a contact surface between the coil portions 42 and 44 and the insulating substrate 23 may be parallel to the fifth surface 105 and the sixth surface 106 of the body 50.

As the body 50 is miniaturized to have a size of 1608 or 1006 or less, a body 50 having a thickness greater than a width is formed and a cross-sectional area of the body 50 in an XZ direction is larger than a cross-sectional area of the body 50 in an XY direction. Therefore, the coil portions 42 and 44 may be formed to stand upright to the third surface 103 or the fourth surface 104 of the body 50 to increase an area in which the coil portions 42 and 44 may be formed.

For example, when the body 50 has a length of 1.6±0.2 mm and a width is 0.8±0.05 mm, a thickness of the body 50 may satisfy a range of 1.0±0.05 mm (a size of 1608). When the body 50 has a length of 0.2±0.1 mm and a width of 0.25±0.1 mm, a thickness of the body 50 may satisfy a maximum range of 0.4 mm (a size of 1006). Since the thickness of the body 50 is greater than the width of the body 50, a larger area may be secured when the coil portions 42 and 44 is vertical to the third surface 103 or the fourth surface 104 of the body 50 than when the coil portions 42 and 44 is horizontal to the third surface 103 or the fourth surface 104 of the body 50. The larger the area in which the coil portions 42 and 44 are formed, the higher inductance L and quality factor Q.

The coil portions 42 and 44 may include one or more conductor layers 51 and 52.

The coil portions 42 and 44 may be formed of a conductive material such as copper (Cu), aluminum (Al), silver (Ag), tin (Sn), gold (Au), nickel (Ni), lead (Pb), or alloys thereof, but the conductive material of the coil portions 42 and 44 is not limited thereto.

The lead-out portions 611 and 612 may extend, respectively, from both end portions of the coil portions 42 and 44 and may be disposed on the tips 231 and 232 of the insulating substrate 23 to be exposed to external surfaces of the body 50. According to an embodiment, the first lead-out portion 611 may extend from one end of the first coil portion 42 to be exposed to the first surface 101 and the third surface 103 of the body 50, and the second lead-out portion 612 may extend from one end of the second coil portion 44 to be exposed to the second surface 102 and the third surface 103 of the body 50.

According to the first embodiment, the lead-out portions 611 and 612 may include lead-out patterns 62 and 64 and dummy patterns 63 and 65, as will be described later. Specifically, a first lead-out portion 611 may include a first lead-out pattern 62, disposed on one surface of the first tip 231 to be connected to one end of the first coil portion 42, and a first dummy pattern 63 disposed on the other surface of the first tip 231 to correspond to the first lead-out pattern 62. A second lead-out portion 612 may include a second lead-out pattern 64, disposed on the other surface of the second tip 232 to be connected to the other end of the second coil portion 44 and spaced apart from the first dummy pattern 63, and a second dummy pattern 65 disposed on one surface of the second tip 232 to correspond to the second lead-out pattern 64.

Referring to FIGS. 1 and 2, one end of the first coil portion 42 may extend to one surface of the insulating substrate 23 to form the first lead-out pattern 62, and the first lead-out pattern 62 may be exposed to the first surface 101 and the third surface 103 of the body 50. In addition, one end of the second coil portion 44 may extend to the other surface of the insulating substrate 23, opposing one surface of the insulating substrate 23, to form the second lead-out pattern 64, and the second lead-out pattern 64 may be exposed to the second surface 102 and the third surface 103 of the body 50.

Referring to FIGS. 1 and 2, external electrodes 851 and 852 to be described later and the coil portions 42 and 44 are connected to each other through the lead-out portions 611 and 612 disposed inside the body 50.

The lead-out portions 611 and 612 are disposed inside the body 50 to have an L shape. The lead-out portions 611 and 612 may be arranged to have a width narrower than a width of the body 50. The first and second lead-out portions 611 and 612 extend from the first surface 101 and the second surface 102 to be led out to the third surface 103, and may not be disposed on the fourth surface 104, the fifth surface 105, and the sixth surface 106 of the body 50.

The lead-out portions 611 and 612 may include a conductive metal such as copper (Cu) and may be formed integrally with each other when the coil portions 42 and 44 are plated. Since the lead-out portions 611 and 612, successively disposed on the first to third surfaces 101, 102, and 103 of the body 50, a contact area between a lead-out portion and an external electrode may be increased, as compared with a bottom electrode structure according to a related art, to achieve miniaturization and high capacitance of a coil electronic component.

Connection conductors 31 and 32 may be disposed on both surfaces of the insulating substrate 23 to connect the lead-out pattern 62 and 64 and the coil portions 42 and 44. Specifically, the first connection conductor 31 may be disposed on one surface of the insulating substrate 23 to connect the first lead-out pattern 62 and the first coil portion 42, and the second connection conductor 32 may be disposed on the other surface of the insulating substrate 23, opposing the one surface of the insulating substrate 23, to connect the second lead-out pattern 64 and the second coil portion 44.

Referring to FIGS. 1 and 2, the connection conductors 31 and 32 may be formed as a plurality of conduction conductor portions spaced apart from each other, respectively. Since the connection conductors 31 and 32 are disposed as a plurality of connection conductor portions spaced apart from each other, the coil conductors 31 and 32 may reliability of connection between the coil portions 42 and 44 and the lead-out patterns 62 and 64 as compared with a single shape. As an example, the first coil portion 42 and the first lead-out pattern 62 are connected by a plurality of the first connection conductors 31 spaced apart from each other. Therefore, even when any one of the plurality of first connection conductor 31 is damaged, electrical and physical connection between the first coil portion 42 and the first lead-out pattern 62 may be maintained through the other first connection conductors.

Since the connection conductors 31 and 32 are disposed as a plurality of connection conductor portions spaced apart from each other, the body 50 may fill gaps between the respective first connection conductors 31. Thus, bonding force between the first connection conductor 31 and the body 50 may be improved.

According to an example, the coil portions 42 and 44, the lead-out patterns 62 and 64, and the connection conductors 31 and 32 may be formed integrally with each other. Specifically, the first coil portion 42, the first lead-out pattern 62, and a first connection conductor 31 are formed integrally with each other, and the second coil portion 44, the second lead-out pattern 64, and the second connection conductor 32 may be formed integrally with each other. Plating resists for formation of the coil portions 42 and 44, the lead-out patterns 62 and 64, and the connection conductors 31 and 32 may be formed integrally with each other. Thus, the lead-out patterns 62 and 64 and the connection conductors 31 and 32 may also be plated when the coil portions 42 and 44 are plated.

The lead-out patterns 62 and 64 and the dummy patterns 63 and 65 are disposed to correspond to the other surface and one surface of the insulating substrate 23, opposing each other, respectively. Since the coil electronic component 100 according to this embodiment further includes the dummy patterns 63 and 65 having a shape symmetrical to the lead-out patterns 62 and 64, the external electrodes 851 and 852 may be formed more symmetrically by plating. As a result, the coil electronic component 100 according to this embodiment may be more stably connected to a mounting substrate.

Referring to FIGS. 1 and 2, the external electrodes 851 and 852 and the coil portions 42 and 44 are connected through the lead-out patterns 62 and 64 and the dummy patterns 63 and 65 disposed inside the body 50. The dummy patterns 63 and 65 may be connected to the lead-out patterns 62 and 64 by vias, not illustrated, and may be directly connected to the external electrodes 851 and 852. Since the dummy patterns 63 and 65 are directly connected to the external electrodes 851 and 852, adhesion strength between the external electrodes 851 and 852 and the body 50 may be improved. Since the body 50 includes an insulating resin and magnetic metal powder particles and the external electrodes 851 and 852 include a conductive metal, they strongly tend not to be mixed with each other. Accordingly, the dummy patterns 63 and 65 may be formed inside the body 50 and then exposed outwardly of the body 50 to achieve additional connection between the external electrodes 851 and 852 and the dummy patterns 63 and 65. Since the connection between the dummy patterns 63 and 65 and the external electrodes 851 and 852 is metal-to-metal bonding, bonding force therebetween is greater than the bonding force between the body 50 and the external electrodes 851 and 852. Accordingly, adhesion force of the external electrodes 851 and 852 to the body 50 may be improved.

At least one of the coil portions 42 and 44, the via electrode 46, the lead-out portions 611 and 612, and the connection conductor 31 and 32 includes one or more conductor layers 51 and 52. According to an example, each of the coil portions 42 and 44, the via electrode 46, the lead-out portions 611 and 612, and the connection conductors 31 and 32 may include a first conductor layer 51 and a second conductor layer 52 disposed at the first conductor layer 51. The second conductor layer 52 may cover a side surface of the first conductor layer 51 on the basis of the exposed surface of each of the first and second lead-out portions 611 and 612.

For example, when the coil portions 42 and 44, the lead-out portions 611 and 612, the connection conductors 31 and 32, and the via electrode 46 are formed on both surfaces of the insulating substrate 23 by plating, each of the coil portions 42 and 44, the lead-out portions 611 and 612, the connection conductors 31 and 32, and the via electrode 46 may include a first conductor layer 51, a seed layer, and a second conductor layer 52, an electroplating layer. The electroplating layer may have a single-layer structure or a multilayer structure. An electroplating layer of a multilayer structure may be formed to have a conformal film structure in which one electroplating layer is covered with another electroplating layer, or may be formed to have a structure in which another electroplating layer is laminated on only one surface of one electroplating layer. A first conductor layer 51 of the coil portions 42 and 44, a first conductor layer 51 of the lead-out patterns 62 and 64, a first conductor layer 51 of the connection conductors 31 and 32, a first conductor layer 51 of the dummy patterns 63 and 65, and a first conductor layer 51 of the via electrode 46 may be formed integrally with each other, such that boundaries therebetween may not be formed, but is not limited thereto. An electroplating layer of the coil portions 42 and 44, an electroplating layer of the lead-out patterns 62 and 64, an electroplating layer of the connection conductors 31 and 32, an electrolytic plating layer of the dummy patterns 63 and 65, and an electroplating layer of the electrode 46 may be formed integrally with each other, such that boundaries therebetween may not be formed, but is not limited thereto.

Each of the coil portions 42 and 44, the lead-out portions 611 and 612, the connection conductors 31 and 32 and the via electrode 46 are formed of copper (Cu), aluminum (Al), silver (Ag), tin (Sn), gold (Au), nickel (Ni), lead (Pb), titanium (Ti), or alloys thereof, but a material thereof is not limited thereto.

In an example, a first conductor layer, a seed layer, is formed on one of one surface and the other surface of the insulating substrate 23, opposing each other, and a plating resist, having an opening for formation of a plating layer, is formed. The plating resist may be a typical photosensitive resist film, such as a dry film resist, but is not limited thereto. After the plating resist is applied, the opening for formation of a plating layer may be formed through exposure and development processes. The opening may be formed to correspond to each of the coil portions 42 and 44, the lead-out portions 611 and 612, the connection conductors 31 and 32, and the via electrodes 46.

Alternatively, after a plating resist and an opening are formed on one surface of the insulating substrate 23, a plating resist and an opening may be formed on the other surface of the insulating substrate 23. Alternatively, a plating resist and an opening may be formed on one surface and the other surface together by the same process.

An opening for formation of a plating layer, disposed in one surface or the other surface of the insulating substrate 23 opposing each other, is filled with a conductive metal to form a second conductor layer. The opening for formation of a plating layer is filled with a conductive metal by electroplating to forma second conductor layer, and a via hole, not illustrated, is filled with a conductive metal by electroplating to form a via electrode 46. Thus, the first conductor layer 51 may be disposed on the tips 231 and 232 of the insulating substrate 23, and a second conductor layer 52 may be disposed at the first conductor layer 51.

By adjusting current density, concentration of a plating solution, a plating rate, and the like, during the electroplating, the second conductor layer may be formed as an isotropic growth plating layer in which a degree of growth in the width direction and a degree of growth in the thickness direction are similar to each other. As described above, by forming the second conductor layer as an isotropic growth plating layer, a difference in thickness between adjacent coils may be reduced to achieve a uniform thickness. Thus, a distribution of DC resistance Rdc may be reduced. In addition, by forming the second conductor layer as an isotropic growth plating layer, the coil portions 42 and 44 and the lead-out portions 611 and 612 may be formed straight, without being bent, to prevent a short-circuit between adjacent coils and to prevent a defect in which an insulating layer, not illustrated, is not formed in portions of the coil portions 42 and 44 and the lead-out portions 611 and 612.

The opening, formed on one surface of the insulating substrate 23, may be subjected to a plating process, and then the opening, formed on the other surface of the insulating substrate 23, may be filled with a conductive metal. However, the above order is not limited thereto, and the openings, formed on one surface and the other surface of the insulating substrate 23, opposing each other, may be simultaneously filled with a conductive metal by the same plating process.

Then, the plating resist is removed, and the first conductor layer 51 is etched to form the first conductor layer 51 only on a bottom surface of the second conductor layer 52.

A method of plating the coil portions 42 and 44 is not limited to the above, and the coil portions 42 and 44 may also be formed by a method of forming a plating resist on a side portion of the first conductor layer 51 after forming the first conductor layer 51 in the form of a coil pattern. A method of plating the lead-out portions 611 and 612 is not also limited to the above, and the lead-out portions 611 and 612 may be formed by forming slits H1 and H2 to penetrate through the lead-out portions 611 and 612 and filling the slits H1 and H2 by plating. As an example, after a first conductor layer 51 is formed on a tip 231, a plating resist may be formed in a side portion of the first conductor layer 51. Then, a conductive material fills an opening for formation of a second conductor layer 52, and the plating resist may be removed to form coil portions 42 and 44 and the lead-out portions 611 and 612 integrally with each other. By such a method, the second conductor layer 52 may be disposed to cover a side surface of the first conductor layer 51.

The first and second lead-out portion 611 and 612 are provided with one or more slits H1, H2, H3, and H4 on the basis of an exposed surface, a surface of the body 100. In this embodiment, the slits H1, H2, H3, and H4 refer to cracks penetrating through plated portions of the lead-out portions 611 and 612 in a thickness direction of the lead-out portions 611 and 612 (corresponding to the width direction Y in the drawings). Such a crack may be formed by placing a plating resist on the tips 231 and 232 penetrate through the lead-out portions 611 and 612, as will be described later.

The slits H1, H2, H3, and H4 may be disposed on the tips 231 and 232 to be perpendicular to the tips 231 and 232 or not to be perpendicular thereto. When the slits H1, H2, H3 and H4 are disposed to be perpendicular to the tips 231 and 232, a plated portion may be significantly increased, as compared with an area occupied by the same lead-out portions 611 and 612, to improve a plating layer pushing-preventing effect in a miniaturized component, which will be described later. For example, the slits H1, H2, H3, and H4 may be disposed to be, in detail, perpendicular to the tips 231 and 232, but the disposition thereof is not limited thereto. The slits H1, H2, H3, and H4 may be formed to be diagonal to the tips 231 and 232.

Referring to FIGS. 1 to 3, the slits H1, H2, H3, and H4 penetrate through the lead-out portions 611 and 612 in a thickness direction of the lead-out portions 611 and 612 (corresponding to the width direction Y in the drawings). In this embodiment, the slits H1, H2, H3, and H4 include a first slit H1 formed in the first lead-out pattern 62, a second slit H2 formed in the first dummy pattern 63, a third slit H3 formed in the lead-out pattern 64, and a fourth slit H4 formed in the third dummy pattern 65. The first and second lead-out portions 611 and 612 are divided into a plurality of conductor portions 81 by the respective slits H1, H2, H3, and H4, as will be described later.

Each of the first and second lead-out portions 611 and 612 may be disposed to be divided into a plurality of lead-out portions spaced apart from each other by the slits H1, H2, H3, and H4. Specifically, the first lead-out pattern 62, disposed on one surface of the first end portion 231, may be divided into a plurality of regions by a plurality of first slits H1, and the first dummy pattern 63, disposed on the other surface of the first end portion 231, may be divided into a plurality of regions by a plurality of second slits H2. Each of the divided regions of the first extraction pattern 62 and each of the divided regions of the first dummy pattern 63 may be disposed to symmetrically correspond to each other about the first tip 231. The second lead-out pattern 64, disposed on the other surface of the second end portion 232, may be divided into a plurality of regions by a plurality of third slits H3, and the second dummy pattern 65, disposed ion the other surface of the second tip 232, may be divided into a plurality of regions by a plurality of fourth slits H4. Each of the divided regions of the second lead-out pattern 64 and each of the divided regions of the second dummy pattern 65 may be disposed to symmetrically correspond to each other about the second tip 232.

Referring to FIG. 4, a minimum spacing distance between respective conductor portions 81, having a diagonal relationship around the first tip 231, may be denoted as d1. In this embodiment, since the lead-out patterns 62 and 64 and the dummy patterns 63 and 65 do not overlap each other, d1 is increased as compared with a case in which even a lead-out pattern and a dummy pattern partially overlap each other.

As described above, each of the regions of the lead-out portions 611 and 612 may be divided into a plurality of regions spaced apart from each other by the plurality of slits H1, H2, H3, and H4. Thus, a plated area itself, disposed on the lead-out portions 611 and 612, may be decreased to reduce an actual volume occupied by a metal in the lead-out portion, as compared with a volume occupied by the same lead-out portion. As a result, a metal component, constituting the lead-out portion, may be prevented from being pushed by a dicing blade during a dicing process. For example, such a phenomenon may be alleviated only by dividing the respective regions of the lead-out portions 611 and 612 by the slits H1, H2, H3, and H4 without filing the slits H1, H2, H3, and H4 with an additional material.

Each of the first and second lead-out portions 611 and 612 includes a plurality of conductor portions 81, spaced apart from each other by slits H1, H2, H3 and H4, and a connection portion 82, embedded in the body 50, connecting the plurality of conductor portions 81 to each other.

In the first embodiment, the conductor portion 81 include a plurality of regions, formed by dividing the first lead-out pattern 62 and the first dummy pattern 63 by the first and second slits H1 and H2, and a plurality of regions formed by dividing the second lead-out pattern 64 and the second dummy pattern 65 by the third and fourth slits H3 and H4. The conductor portion 81 refers to a plurality of regions separated and spaced apart from each other by the slits H1, H2, H3, and H4 from the exposed surface of the body 50 to a region of inside of the body 50. Accordingly, the plated area itself, disposed in the lead-out portions 611 and 612, may be reduced to prevent a metal component, constituting the lead-out portion, from being pushed by a dicing blade during a dicing process.

The connection portion 82 extends to each of the conductor portions 81, spaced apart from each other, in the lead-out portions 611 and 612 to connect the lead-out portions 611 and 612 and the coil portions 42 and 44. The first connection conductor 31 and the first lead-out pattern 62 may be connected through the connection portion 82, and the second connection conductor 32 and the second lead-out pattern 64 may be connected through the connection portion 82. Thus, the coil portions 42 and 44 and the lead-out portions 611 and 612 may be connected to each other.

The insulating layer 30 may be disposed on internal walls of the slits H1, H2, H3, and H4 to be formed between each of the plurality of conductor portions 81 and the body 50. Although not illustrated in detail, since the first and second coil portions 42 and 44 and the first and second lead-out portions 611 and 612 are integrally formed by placing, the insulating layer 30 may extend from the coil portions 42 and 44 and the lead-out portions 611 and 612 along the connection conductors 31 and 32.

According to the first embodiment, the insulating layer 30 may be disposed on an internal wall of at least one of the first slit H1 formed in the first lead-out pattern 62, the second slit H2 formed in the first dummy pattern 63, the third slit H3 formed in the second lead-out pattern 64, and the fourth slit H4 formed in the second dummy pattern 65. The first slits H1 may include a group exposed to the first surface 101 and another group exposed to the third surface 103, the second slits H2 may include a group exposed to the first surface 101 and another group exposed to the third surface 103, the third slits H3 may include a group exposed to the second surface 102 and another group exposed to the third surface 103, and the fourth slits H4 may include a group exposed to the second surface 102 and another group exposed to the third surface 103. The insulating layer 30 covers the lead-out patterns 62 and 64, the dummy patterns 63 and 65, and the tips 231 and 232 to prevent a direct contact between the magnetic material, constituting the body 50, and the plurality of conductor portions 81. Furthermore, the insulating layer 30 may cover the respective divided regions of the lead-out portions 611 and 612 to serve as a prevention layer to prevent a plating layer, disposed on the lead-out portions 611 and 612, from being pushed or bled.

The insulating layer 30 may be formed by coating an insulating material such as parylene through vapor deposition, but a formation method thereof is not limited thereto. For example, the insulating layer 30 may be formed by a known method such as a screen printing method, exposure of a photoresist (PR), a process through development, a spray coating process, or the like.

The external electrodes 851 and 852 are disposed on the first surface 101, the second surface 102, and the third surface 103 of the body 50.

Although not illustrated in detail, the external electrodes 851 and 852 may be disposed on the first and third surfaces 101 and 103 to be connected to the first and third lead-out patterns 62 and 64 exposed to the first surface 101 and the third surface 103 of the body 50. Each of the external electrodes 851 and 852 may have a width smaller than a width of the body 50. The first external electrode 851 may cover the first lead-out portion 611 and may extend from the first surface 101 of the body 50 onto the third surface 103. However, the first external electrode 851 is not disposed on the fourth surface 104, the fifth surface 105, and the sixth surface 106 of the body 50. The second external electrode 852 may cover the second lead-out portion 612 and may extend from the second surface 102 of the body 50 onto the third surface 103. However, the second external electrode 852 is not disposed on the fourth surface 104, the fifth surface 105, and the sixth surface 106 of the body 50.

Each of the external electrodes 851 and 852 may be formed to have a single-layer structure or a multilayer structure. The external electrode 851 may include a first layer, covering the lead-out portion 611, and a second layer covering the first layer. The external electrode 852 may include a first layer, covering the lead-out portion 612, and a second layer covering the first layer. Specifically, the first layer includes nickel (Ni) and the second layer includes tin (Sn).

Embodiment 2

Figure 7:
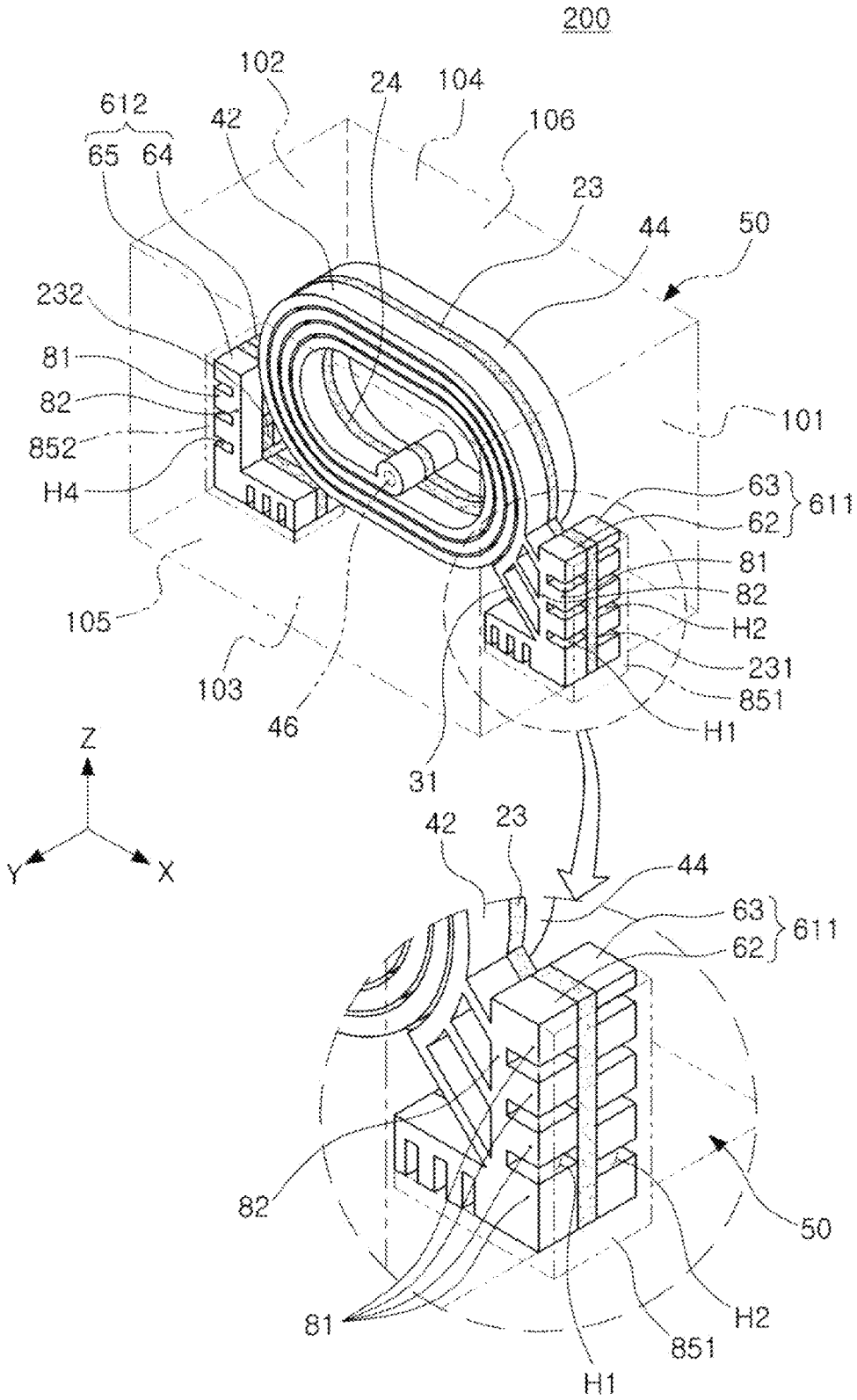
FIG. 7 is a schematic perspective view of a coil electronic component according to a second embodiment in the present disclosure.
Figure 8:
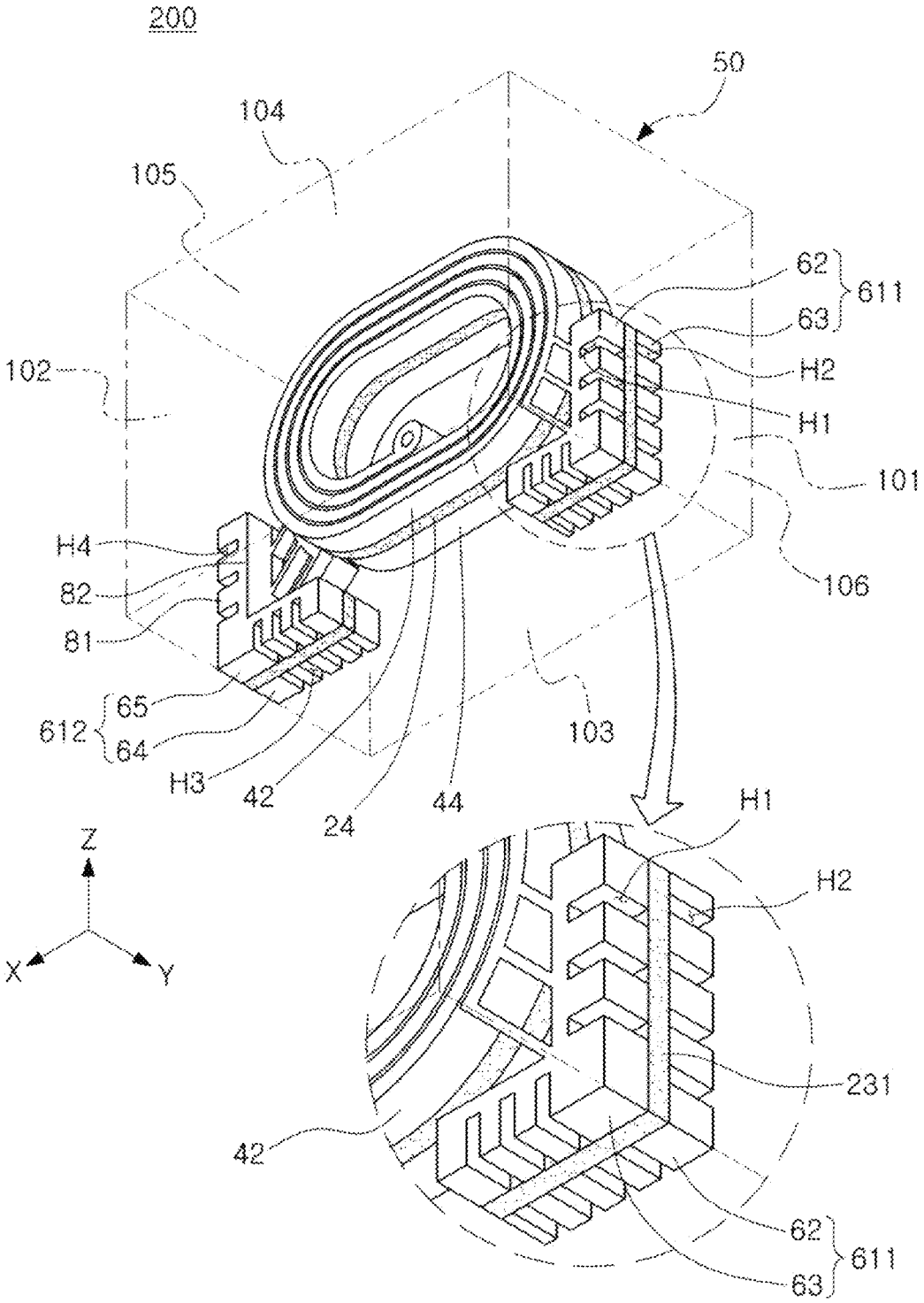
FIG. 8 is a perspective view of the coil electronic component according to the second embodiment, illustrated in FIG. 7, when viewed from a third surface.
Figure 9:
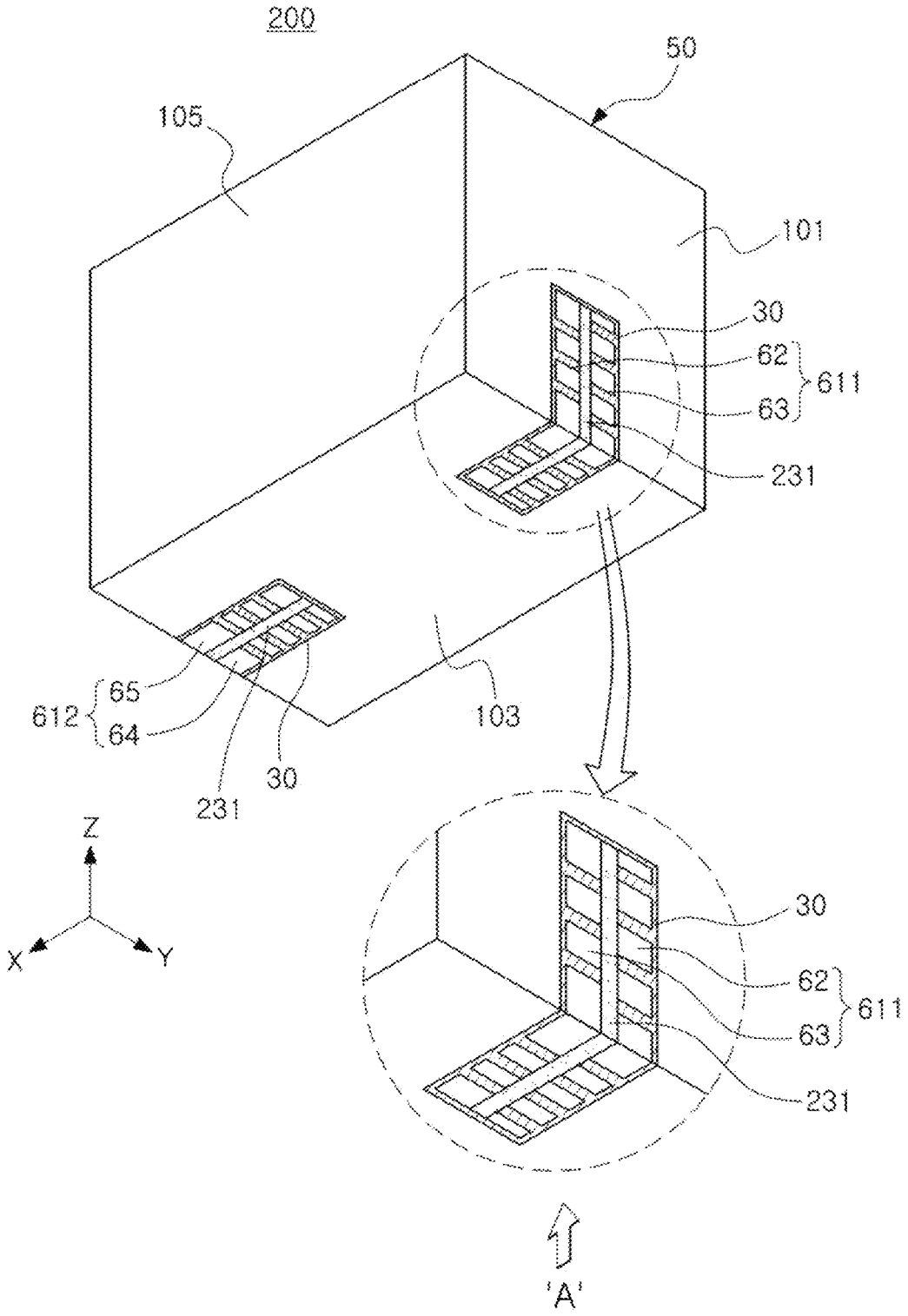
FIG. 9 is a perspective view of a body of the coil electronic component according to the second embodiment, illustrated in FIG. 7, when viewed from the third surface.
Figure 10:
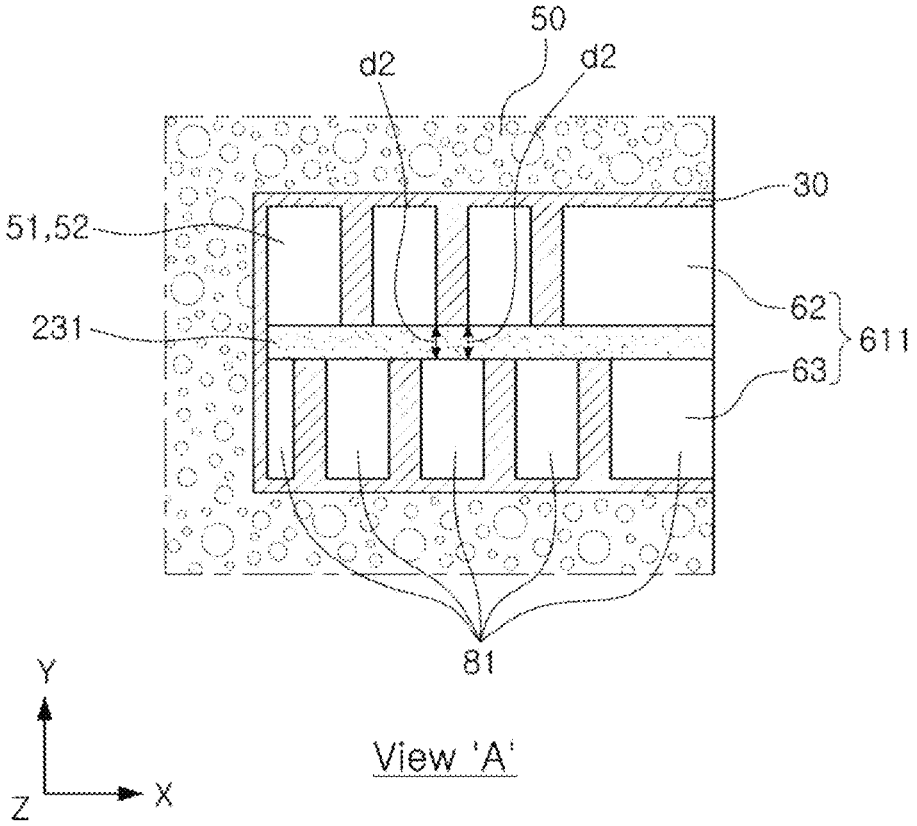
FIG. 10 is a diagram when

FIG. 7 is a schematic perspective view of a coil electronic component according to a second embodiment in the present disclosure. FIG. 8 is a perspective view of the coil electronic component according to the second embodiment, illustrated in FIG. 7, when viewed from a third surface. FIG. 9 is a perspective view of a body of the coil electronic component according to the second embodiment, illustrated in FIG. 7, when viewed from the third surface. FIG. 10 is a diagram when FIG. 9 is viewed in direction A.

Referring to FIGS. 7 to 10, a coil electronic component 200 according to the second embodiment is different in arrangement of slits H1, H2, H3, and H4 from the coil electronic component 100 of the first embodiment. Therefore, only the arrangement of the slits H1, H2, H3, and H4, different from that of the first embodiment, will be described. The other components of the second embodiment may be the same as those in the first embodiment.

In the second embodiment, a first slit H1 and a second slit H2 are disposed to be separated from each other on the basis of an exposed surface of a first lead-out portion 611, and a third slit H3 and a fourth slit H4 may be disposed to be separated from each other on the basis of an exposed surface of a second lead-out portion 612.

Specifically, a plurality of divided regions of the first lead-out pattern 62 and a plurality of divided regions of a first dummy pattern 63 are disposed to be separated from each other about a first tip 231. The expression "disposed to be separated from each other" includes not only a case in which a plurality of divided regions of the first lead-out pattern 62 and a plurality of divided regions of the first dummy pattern 63 are disposed to be fully separated from each other about the first tip 231, but also a case in which they are disposed to partially overlap each other about the first tip 231. Each of a plurality of regions, in which the first lead-out pattern 62 and the first dummy pattern 63 are divided by the first and second slits H1 and H2, constitute a conductor portion 81 filled with a conductor, as will described later. When each of the plurality of divided regions of the first lead-out pattern 62 and the first dummy pattern 63 have a region overlapped with each other on the basis of the first tip 231, a diagonally spacing distance d2 between conductor portions 81 may be further reduced as compare to the case in which they are disposed to be fully separated from each other. Referring to FIGS. 4 and 10, a minimum spacing distance d2 between the conductor portions 81, disposed on one surface of the first tip 231, and the conductor portions 81, disposed diagonally on the other surface of the first tip 231, when the conductor portions 81 are disposed to be separated from each other, may be reduced as compared with a minimum spacing distance d1 between the conductor 81, disposed on one surface of the first tip 231 and a conductor 81, disposed diagonally on the other surface of the first tip 231, when the conductors 81 are disposed to be symmetrical to each other. As a result, in the diagonal direction, when external electrodes 851 and 852 are formed on exposed surfaces of the lead-out patterns 62 and 64 and the dummy patterns 63 and 65 by plating, a plating deviation between a region plated region on the conductor layers 231 and 232 of the external electrodes 851 and 852 and a region plated on conductor layers 51 and 52 of the external electrodes 851 and 852 may be reduced and a the plating growth rate may be increased.

A plurality of divided regions of the second lead-out pattern 64 and a plurality of divided regions of the second dummy pattern 65 may be disposed to be separated from each other about the second end portion 232. The expression "disposed to be separated from each other" includes not only a case in which a plurality of divided regions of the second lead-out pattern 64 and a plurality of divided regions of the second dummy pattern 65 are disposed to be fully separated from each other about the second tip 232, but also a case in which they are disposed to partially overlap each other about the second tip 232. Each of a plurality of regions, in which the second lead-out pattern 64 and the second dummy pattern 65 are divided by the third and fourth slits H3 and H4, constitute a conductor portion 81 filled with a conductor, as will described later. When each of the plurality of divided regions of the second lead-out pattern 64 and the second dummy pattern 65 have a region overlapped with each other on the basis of the second tip 232, a diagonally spacing distance d2 between conductor portions 81 may be further reduced as compare to the case in which they are disposed to be fully separated from each other. Although not illustrated in detail, a minimum spacing distance d2 between the conductor portions 81, disposed on one surface of the second tip 232, and the conductor portions 81, disposed diagonally on the other surface of the second tip 232, when the conductor portions 81 are disposed to be separated from each other, may be reduced as compared with a minimum spacing distance d1 between the conductor 81, disposed on one surface of the second tip 232 and a conductor 81, disposed diagonally on the other surface of the second tip 232, when the conductors 81 are disposed to be symmetrical to each other. As a result, in the diagonal direction, when external electrodes 851 and 852 are formed on exposed surfaces of the lead-out patterns 62 and 64 and the dummy patterns 63 and 65 by plating, a plating deviation between a region plated region on the conductor layers 231 and 232 of the external electrodes 851 and 852 and a region plated on conductor layers 51 and 52 of the external electrodes 851 and 852 may be reduced and a the plating growth rate may be increased.

Embodiment 3

Figure 11:
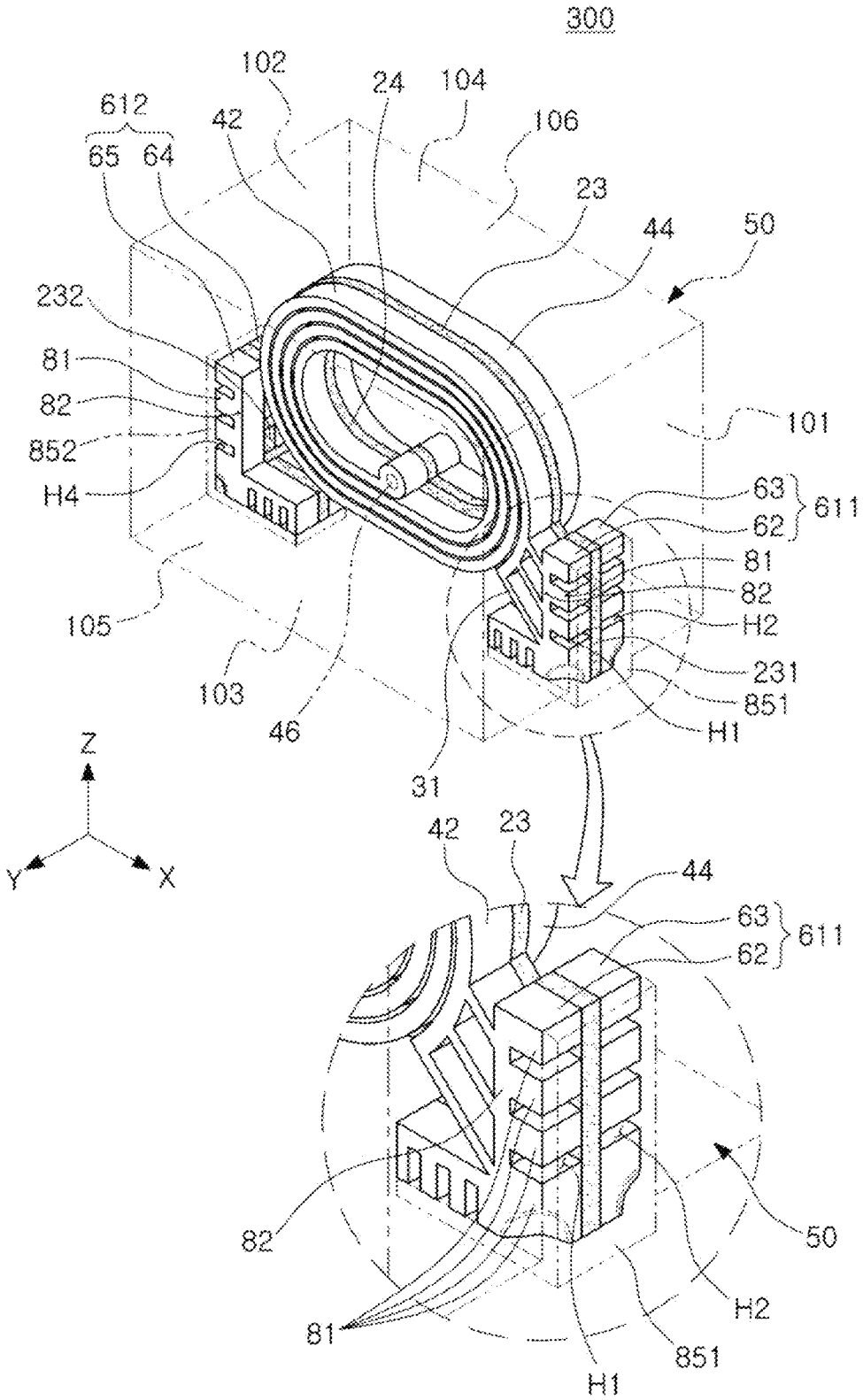
FIG. 11 is a schematic perspective view of a coil electronic component according to a third embodiment in the present disclosure.
Figure 12:
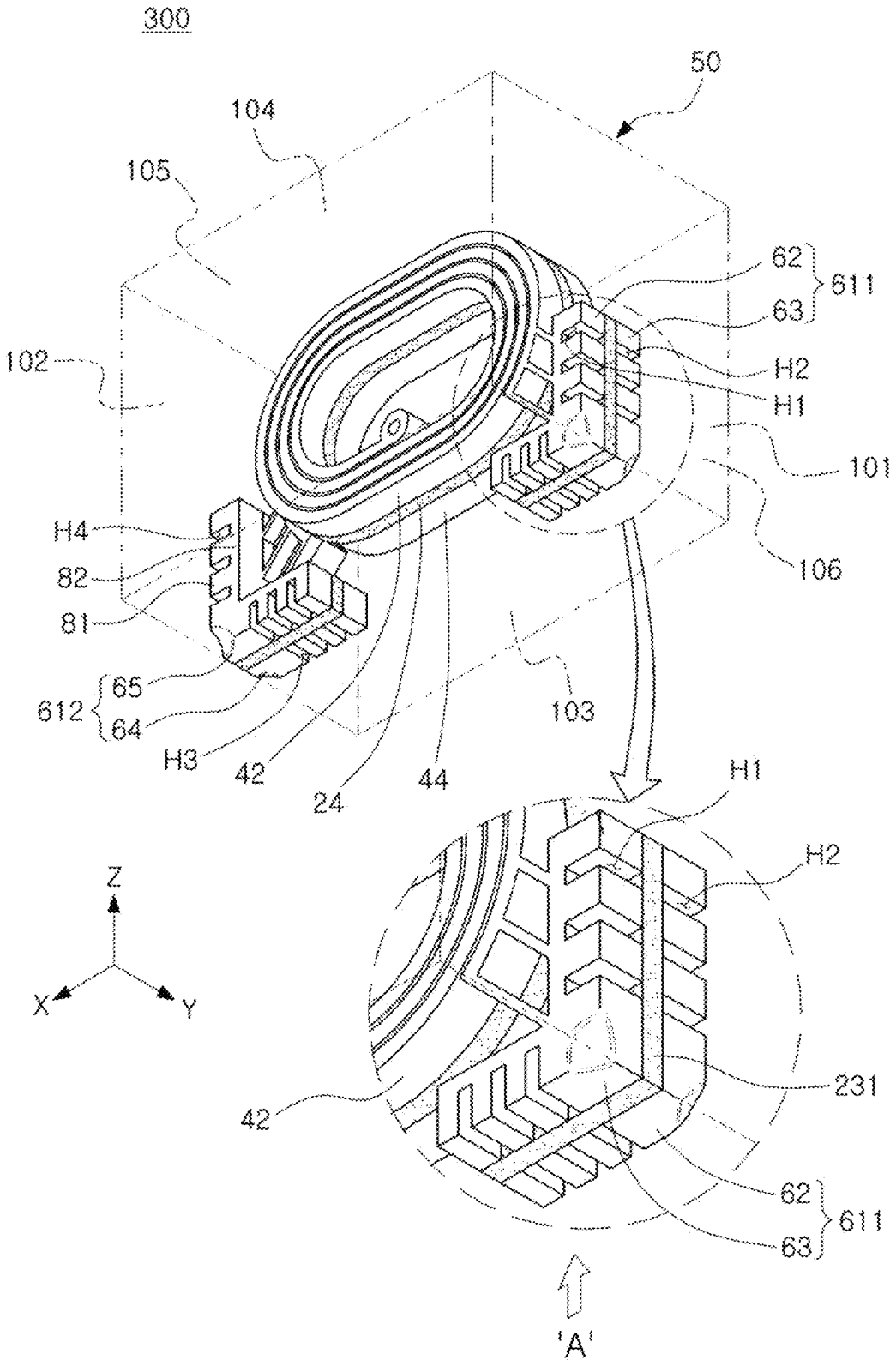
FIG. 12 is a perspective view of the coil electronic component according to the third embodiment, illustrated in FIG. 11, when viewed from a third surface.
Figure 13:
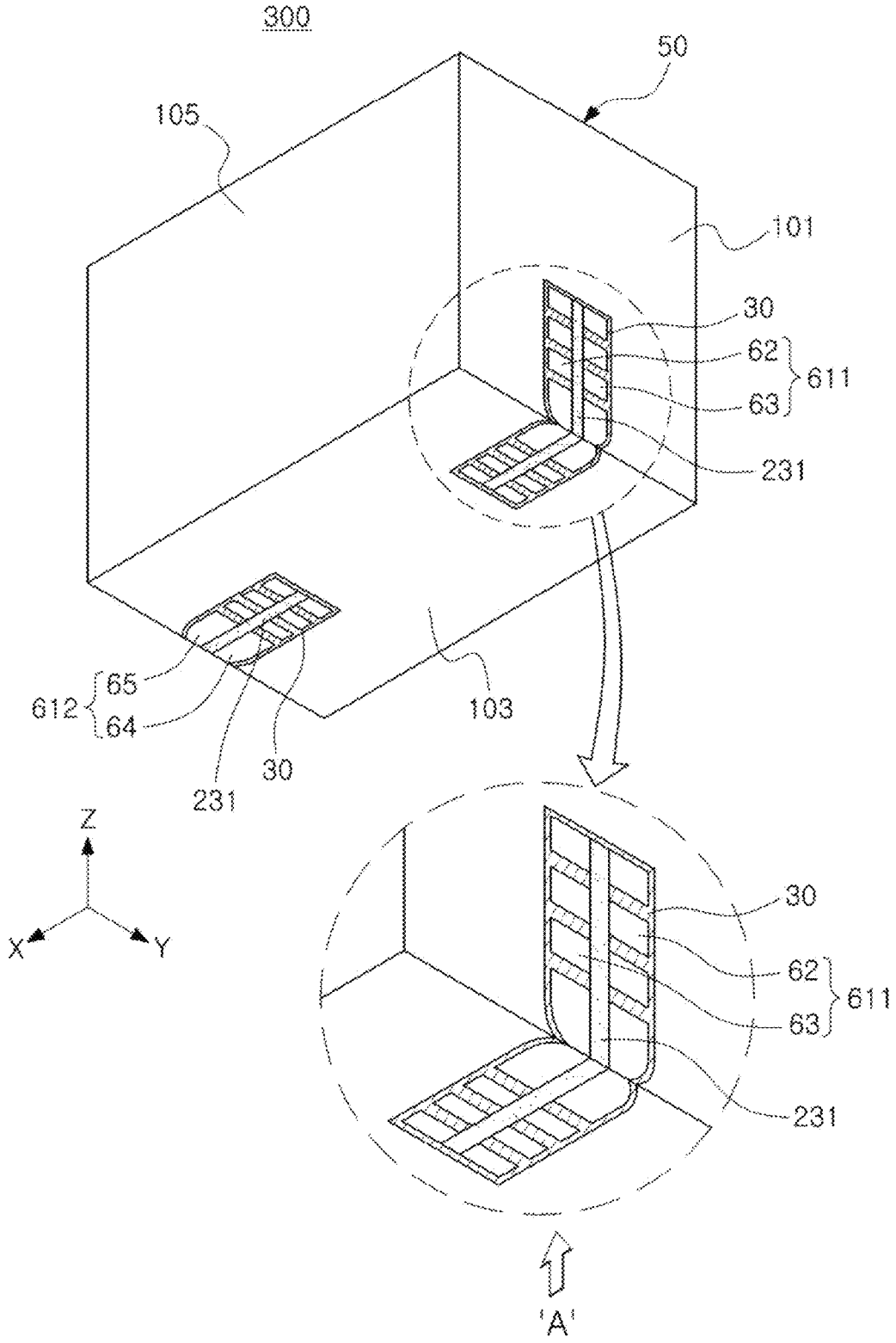
FIG. 13 is a perspective view of a body of the coil electronic component according to the third embodiment, illustrated in FIG. 11, when viewed from the third surface.
Figure 14:
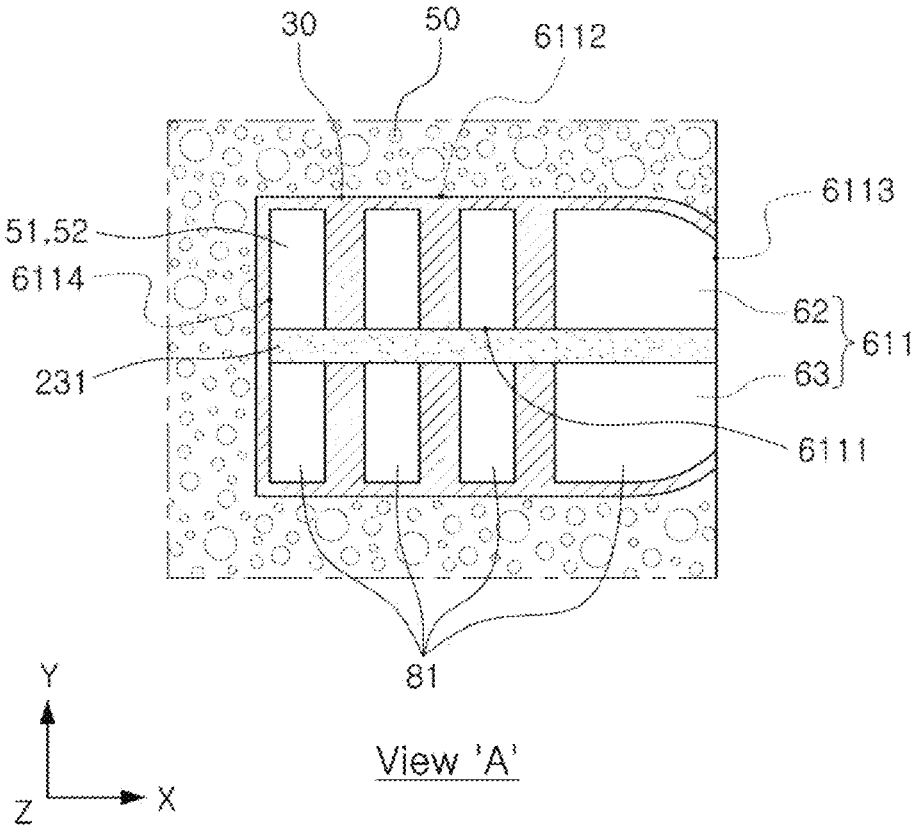
FIG. 14 is a diagram when

FIG. 11 is a schematic perspective view of a coil electronic component according to a third embodiment in the present disclosure. FIG. 12 is a perspective view of the coil electronic component according to the third embodiment, illustrated in FIG. 11, when viewed from a third surface. FIG. 13 is a perspective view of a body of the coil electronic component according to the third embodiment, illustrated in FIG. 11, when viewed from the third surface. FIG. 14 is a diagram when FIG. 13 is viewed in direction A.

Referring to FIGS. 11 to 14, a coil electronic component 300 according to the third embodiment is different in a shape of exposed surfaces of lead-out portions 611 and 612 from the coil electronic component according to the first embodiment. Therefore, only the shape of the exposed surfaces of the lead-out portions 611 and 612, different from that of the first embodiment, will be described. The other components of the third embodiment may be the same as those in the first embodiment.

In the third embodiment, a first lead-out portion 611 is exposed to first and third surfaces 101 and 103 of a body 50, and a second lead-out portion 612 is exposed to second and third surfaces 102 and 103.

The exposed surface of the first lead-out portions 611 has a first region 6111 disposed in contact with a first tip 231, a second region 6112 opposing the first region 6111, a third region 6113 and a fourth region 6114, each connecting the first region 6111 and the second region 6112, opposing each other. A distance between the third region 6113 and the fourth region 6114 is longer in the first region 6111 than in the second region 6112. In the first embodiment, a plurality of small-sized vias, not illustrated, are formed to integrally penetrate through lead-out patterns 62 and 64, dummy patterns 63, and tips 231 and 232 to electrically connect the lead-out patterns 62 and 64 and the dummy patterns 63 and 65 to each other. In this case, as a conductor fills the plurality of vias, not illustrated, the lead-out portions 611 and 612 remain in a recessed shape in a portion in which a plurality of vias, not illustrated, are formed. When a plurality of vias, not illustrated, are formed, electrical connectivity may be improved, while a recessed area is increased. In this embodiment, one large-sized via may be formed to reduced an entire area of a recessed portion, as compared with a case in which a plurality of vias, not illustrated, are formed. As a result, the exposed areas of the lead-out portions 611 and 612 may be decreased as coming close to an edge of the body 50. For example, a distance between the third region 6113 and the fourth region 6114 is longer in the first region 6111 than in the second region 6112. As an example, a distance between the third region 6113 and the fourth region 6114 may be reduced in a direction from the first region 6111 to the second region 6112.

The exposed surface of each of the second lead-out portions 612 has a first region disposed in contact with a second tip 231, a second region opposing the first region, a third region and a fourth region, each connecting the first region and the second region, opposing each other. A distance between the third region and the fourth region is longer in the first region than in the second region. In the first embodiment, a plurality of small-sized vias, not illustrated, are formed to integrally penetrate through lead-out patterns 62 and 64, dummy patterns 63, and tips 231 and 232 to electrically connect the lead-out patterns 62 and 64 and the dummy patterns 63 and 65 to each other. In this case, as a conductor fills the plurality of vias, not illustrated, the lead-out portions 611 and 612 remain in a recessed shape in a portion in which a plurality of vias, not illustrated, are formed. When a plurality of vias, not illustrated, are formed, electrical connectivity may be improved whereas a recessed area is increased. In this embodiment, one large-sized via may be formed to reduced an entire area of a recessed portion, as compared with a case in which a plurality of vias, not illustrated, are formed. As a result, the exposed areas of the lead-out portions 611 and 612 may be decreased as coming close to an edge of the body 50. For example, a distance between the third region and the fourth region is longer in the first region than in the second region. As an example, a distance between the third region and the fourth region may be reduced in a direction from the first region to the second region.

Embodiment 4

Figure 15:
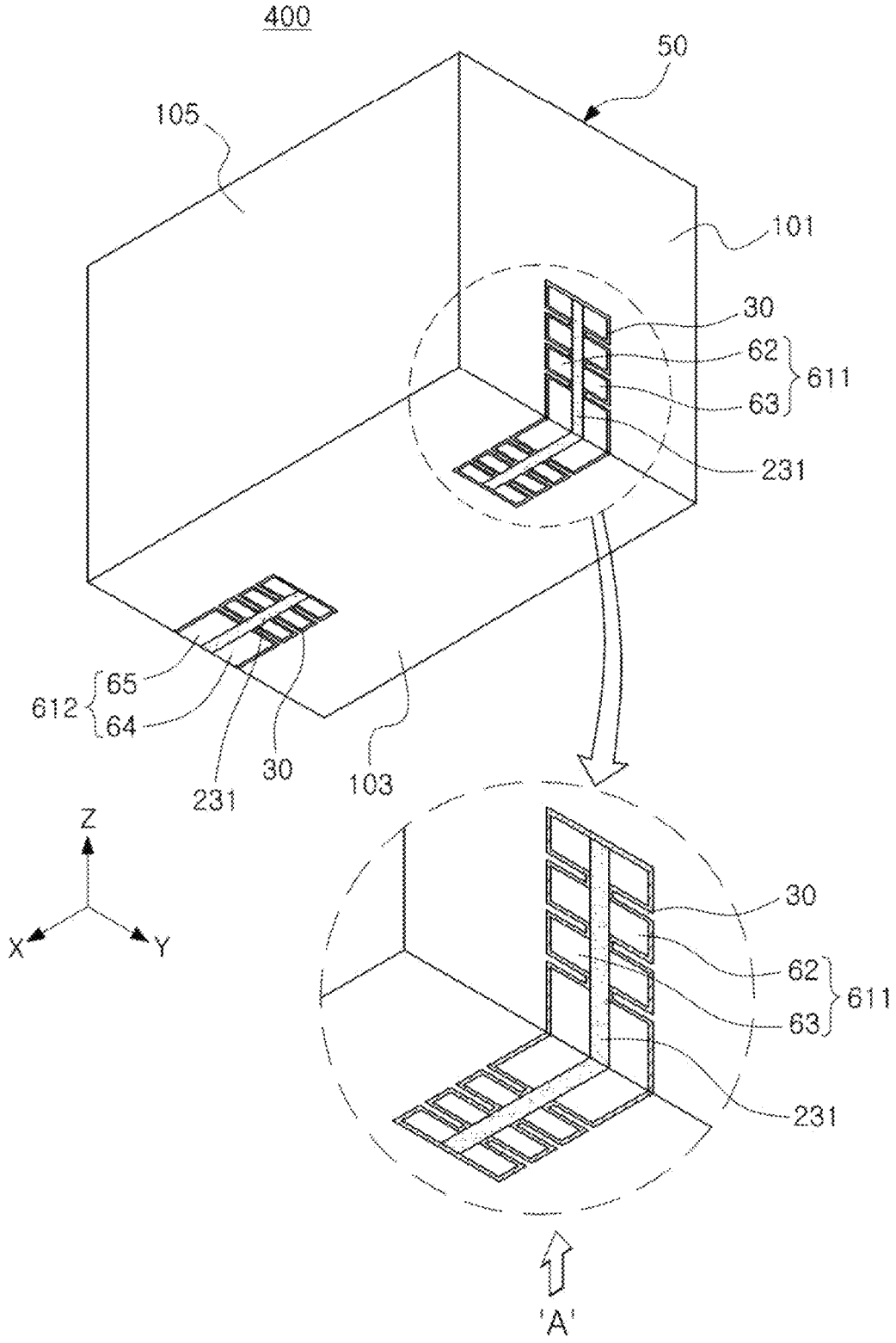
FIG. 15 is a perspective view of a body of a coil electronic component according to a fourth embodiment in the present disclosure when viewed from a third surface.
Figure 16:
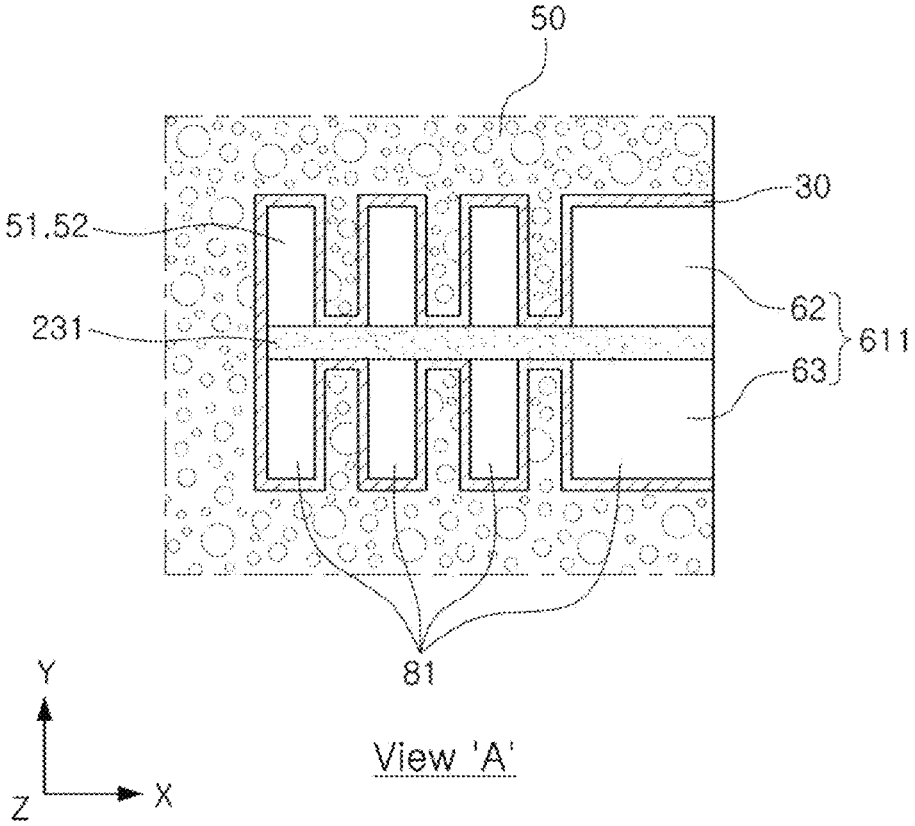
FIG. 16 is a diagram when

FIG. 15 is a perspective view of a body of a coil electronic component according to a fourth embodiment in the present disclosure when viewed from a third surface, and FIG. 16 is a diagram when FIG. 15 is viewed in direction A.

Referring to FIGS. 15 and 16, a coil electronic component 400 according to the fourth embodiment is different in a disposition of an insulating layer 30 from the coil electronic component 100 according to the first embodiment. Therefore, only the disposition of the insulating layer 30, different from that of the first embodiment, will be described. The other components of the third embodiment may be the same as those in the first embodiment.

According to the fourth embodiment, the insulating layer 30 is disposed along surfaces of a plurality of conductor portions 81 and surfaces of tips 231 and 232 to form an exposed region between the plurality of conductor portions 81. As a result, a magnetic material of a body 50 may fill the exposed region. The insulating layer 30 may be conformally disposed along the surfaces of the respective conductor portions 81 and the surfaces of the tips 231 and 232 to form a thin film. As a method of forming the insulating layer 30, a method of reducing a width of each of the plurality of conductor portions 81 to further increase a spacing distance between the conductor portions 81 may be used. In this case, as compared with the first embodiment, an exposed region may be formed by an increase in the spacing distance, and a magnetic material of the body 50 may fill the exposed region to further increase inductance.

A method of forming a conformal insulating layer 30 by significantly reducing a thickness of the insulating layer 30 itself may also be used. In this case, as compared with the first embodiment, an exposed region may be formed by a decrease in the thickness of the insulating layer 30, and a magnetic material may further fill the exposed region to further increase inductance.

In this embodiment, as described above, a thinner insulating layer 30 may be disposed to increase inductance of a miniaturized coil component, as compared to the first embodiment.

As described above, according to the present disclosure, a portion of a metal component, constituting a lead-out portion of a coil component, may be prevented from being pushed to a surface of a body.

While example embodiments have been shown and described above, it will be apparent to those skilled in the art that modifications and variations could be made without departing from the scope of the present disclosure as defined by the appended claims.

What is claimed is:

1. A coil electronic component:

a body comprising a magnetic material;

an insulating substrate comprising a support portion disposed inside the body, and a tip extending from the support portion and exposed from an external surface of the body;

a coil portion disposed on the support portion; and a lead-out portion extending from one end of the coil portion, disposed on the tip, and exposed from the external surface of the body, wherein the lead-out portion has a slit exposed from the external surface of the body, the body has a first surface and a second surface, opposing each other, and a third surface connecting the first and second surfaces to each other, the lead-out portion is exposed from the first and third surfaces of the body, the exposed surface of the lead-out portion has a first region in contact with the tip, a second region facing the first region, and third and fourth regions, each connecting the first and second regions, facing each other, and a distance between the third and fourth regions is longer in the first region than in the second region.

2. The coil electronic component of claim 1, wherein the slit penetrates through the lead-out portion in a thickness direction of the lead-out portion.

3. The coil electronic component of claim 1, wherein a distance between the third and fourth regions is decreased in a direction from the first region to the second region.

4. The coil electronic component of claim 1, wherein the lead-out portion has a width narrower than a width of the body.

5. The coil electronic component of claim 1, further comprising:

an external electrode covering the lead-out portion.

6. The coil electronic component of claim 1, wherein the lead-out portion comprises:

a lead-out pattern disposed one surface of the tip and connected to the one end of the coil portion; and a dummy pattern disposed on the other surface of the tip to correspond to the lead-out pattern.

7. The coil electronic component of claim 6, wherein the slit comprises a first slit in the lead-out pattern and a second slit in the first dummy pattern, and the first slit and the second slit are separated from each other on the basis of the exposed surface of the lead-out portion.

8. The coil electronic component of claim 7, wherein the first and second slits are symmetrical with respect to the tip.

9. The coil electronic component of claim 7, wherein the first and second slits are asymmetrical with respect to the tip.

10. The coil electronic component of claim 1, wherein the lead-out portion comprises a first conductor layer disposed on the tip and a second conductor layer disposed on the first conductor layer.

11. The coil electronic component of claim 10, wherein the second conductor layer covers a side surface of the first conductor on the basis of the exposed surface of the lead-out portion.

12. The coil electronic component of claim 1, wherein the lead-out portion comprises:

a plurality of conductor portions spaced apart from each other by the slit; and a connection portion, embedded in the body, connecting the plurality of conductor portions to each other.

13. The coil electronic component of claim 12, further comprising:

an insulating layer disposed between each of the plurality of conductor portions and the body and disposed in the slit.

14. The coil electronic component of claim 13, wherein the insulating layer is disposed along surfaces of the plurality of conductor portions and the tip to form an exposed region between the plurality of the conductor portions, and the body fills the exposed region.

15. A coil electronic component:

a body comprising a magnetic material;

an insulating substrate comprising a support portion disposed inside the body, and first and second tips extending from the support portion and exposed from first and second surfaces of the body in a length direction of the body, respectively;

a coil portion disposed on the support portion; and first and second lead-out portions extending from ends of the coil portion, disposed on the first and second tips, and exposed from the first and second surfaces of the body, respectively, wherein the first and second lead-out portions are exposed from a third surface of the body connecting the first and second surfaces, the first lead-out portion has a first slit exposed from one of the first surface or the third surface, and the second lead-out portion has a second slit exposed from one of the second surface or the third surface, the exposed surface of the first lead-out portion has a first region in contact with the first tip, a second region facing the first region, and third and fourth regions, each connecting the first and second regions, facing each other, and a distance between the third and fourth regions is longer in the first region than in the second region.

16. The coil electronic component of claim 15, wherein the first and second slits penetrate through the first and second lead-out portions in a thickness direction of the lead-out portion, respectively.

17. The coil electronic component of claim 15, wherein the first lead-out portion comprises:

a first lead-out pattern disposed one surface of the first tip and connected to the one end of the coil portion; and a first dummy pattern disposed on the other surface of the first tip to correspond to the first lead-out pattern, and the second lead-out portion comprises:

a second lead-out pattern disposed one surface of the second tip and connected to the other end of the coil portion; and a second dummy pattern disposed on the other surface of the second tip to correspond to the second lead-out pattern.

18. The coil electronic component of claim 15, further comprising:

first and second insulating layers filling portions of the first and second slits, respectively.

19. The coil electronic component of claim 15, further comprising:

first and second external electrode covering the first and second lead-out portions.

20. A coil electronic component:

a body comprising a magnetic material;

an insulating substrate comprising a support portion disposed inside the body, and a tip extending from the support portion and exposed from an external surface of the body;

a coil portion disposed on the support portion; and a lead-out portion extending from one end of the coil portion, disposed on the tip, and exposed from the external surface of the body, wherein the lead-out portion has a slit exposed from the external surface of the body, wherein the lead-out portion comprises:

a lead-out pattern disposed one surface of the tip and connected to the one end of the coil portion; and a dummy pattern disposed on the other surface of the tip to correspond to the lead-out pattern, the slit comprises a first slit in the lead-out pattern and a second slit in the first dummy pattern, and the first slit and the second slit are separated from each other on the basis of the exposed surface of the lead-out portion.

* * * * *